US010507687B1

(12) United States Patent
Hill, III

(10) Patent No.: US 10,507,687 B1
(45) Date of Patent: Dec. 17, 2019

(54) COMBINATION WRITING UTENSIL AND HANDCUFF TOOL

(71) Applicant: Luther Hill, III, Conyers, GA (US)

(72) Inventor: Luther Hill, III, Conyers, GA (US)

( * ) Notice: Subject to any disclaimer, the term of this patent is extended or adjusted under 35 U.S.C. 154(b) by 0 days.

(21) Appl. No.: 15/478,095

(22) Filed: Apr. 3, 2017

(51) Int. Cl.
*B43K 29/00* (2006.01)
*B43K 29/18* (2006.01)
*B43K 24/00* (2006.01)

(52) U.S. Cl.
CPC ..... *B43K 29/18* (2013.01); *B43K 24/00* (2013.01); *B43K 29/004* (2013.01)

(58) Field of Classification Search
CPC ..... B43K 29/004; B43K 29/18
USPC ..... 401/195
See application file for complete search history.

(56) References Cited

U.S. PATENT DOCUMENTS 4,778,302 A * 10/1988 Martinez ..... B43K 29/00 401/110
5,460,022 A * 10/1995 Parsons ..... A45C 11/321 206/37.1
5,916,278 A 6/1999 Garcia
6,640,450 B2 11/2003 Teague
6,880,369 B2 * 4/2005 Parsons ..... B43K 25/026 70/16
7,296,316 B1 11/2007 Wu
7,520,149 B1 * 4/2009 Roemmele ..... B43K 7/005 401/195
9,322,193 B2 * 4/2016 Chen ..... E05B 75/00

* cited by examiner

*Primary Examiner* — Jennifer C Chiang

(57) ABSTRACT

A combination writing utensil and handcuff tool including a writing utensil having a slotted interior chamber and a plurality of spring-loaded buttons. A pair of writing tips is disposed within the slotted interior chamber, with each of a first of the pair of writing tips and a second of the pair of writing tips engaged with each of a first of the plurality of spring-loaded buttons and a second of the plurality of spring-loaded buttons, respectively, and lockably extended through an opening of the writing utensil. Additionally, each of a handcuff key and a handcuff lock is disposed within the slotted interior chamber of the writing utensil. Each of the handcuff key and the handcuff lock is engaged with each of a third of the plurality of spring-loaded buttons and a fourth of the plurality of spring-loaded buttons, respectively, and lockably extended through the opening of the writing utensil.

3 Claims, 4 Drawing Sheets

COMBINATION WRITING UTENSIL AND HANDCUFF TOOL

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of writing utensils are known in the prior art. However, what has been needed is a combination writing utensil and handcuff tool including a writing utensil having a slotted interior chamber and a plurality of spring-loaded buttons. What has been further needed is a pair of writing tips disposed within the slotted interior chamber, with each of a first of the pair of writing tips and a second of the pair of writing tips engaged with each of a first of the plurality of spring-loaded buttons and a second of the plurality of spring-loaded buttons, respectively, and selectively lockably extended through an opening of the writing utensil. Lastly, what has been needed is each of a handcuff key and a handcuff lock disposed within the slotted interior chamber of the writing utensil, with each of the handcuff key and the handcuff lock engaged with each of a third of the plurality of spring-loaded buttons and a fourth of the plurality of spring-loaded buttons, respectively, and selectively lockably extended through the opening of the writing utensil. The combination writing utensil and handcuff tool is thus uniquely structured to aid any type of law enforcement or security officer in safely and quickly switching between issuing a ticket and performing an arrest of a suspect.

FIELD OF THE INVENTION

The present invention relates to writing utensils, and more particularly, to a combination writing utensil and handcuff tool.

SUMMARY OF THE INVENTION

The general purpose of the present combination writing utensil and handcuff tool, described subsequently in greater detail, is to provide a combination writing utensil and handcuff tool which has many novel features that result in a combination writing utensil and handcuff tool which is not anticipated, rendered obvious, suggested, or even implied by prior art, either alone or in combination thereof.

To accomplish this, the present combination writing utensil and handcuff tool includes an elongated substantially cylindrical writing utensil having a lower portion, an upper portion disposed atop the lower portion, a cap disposed on a top end of the upper portion, a slotted interior chamber, an opening disposed in a bottom end of the lower portion, and a plurality of spring-loaded depressible and releasable buttons disposed within the upper portion proximal the top end.

A pair of writing tips is disposed within the slotted interior chamber of the elongated substantially cylindrical writing utensil, with a first of the pair of writing tips engaged with a first of the plurality of spring-loaded depressible and releasable buttons and selectively lockably extended through the opening of the elongated substantially cylindrical writing utensil, and a second of the pair of writing tips engaged with a second of the plurality of spring-loaded depressible and releasable buttons and selectively lockably extended through the opening of the elongated substantially cylindrical writing utensil. It is envisioned that each of the pair of writing tips will contain a different color of ink.

The combination writing utensil and handcuff tool further includes a handcuff key disposed within the slotted interior chamber of the elongated substantially cylindrical writing utensil. Similar to each of the pair of writing tips, the handcuff key is engaged with a third of the plurality of spring-loaded depressible and releasable buttons and selectively lockably extended through the opening of the elongated substantially cylindrical writing utensil. Lastly, a handcuff lock is disposed within the slotted interior chamber of the elongated substantially cylindrical writing utensil. The handcuff lock is engaged with a fourth of the plurality of spring-loaded depressible and releasable buttons and selectively lockably extended through the opening of the elongated substantially cylindrical writing utensil. The combination writing utensil and handcuff tool is uniquely structured to allow a law enforcement or private security officer to easily and quickly switch between writing tickets and performing an arrest of a suspect.

At least one rubberized gripping member is optionally disposed around a circumference of the lower portion of the elongated substantially cylindrical writing utensil, with the at least one rubberized gripping member optionally three.

Thus has been broadly outlined the more important features of the present combination writing utensil and handcuff tool so that the detailed description thereof that follows may be better understood and in order that the present contribution to the art may be better appreciated.

BRIEF DESCRIPTION OF THE DRAWINGS FIGURES

DETAILED DESCRIPTION OF THE DRAWINGS

Figure 1:
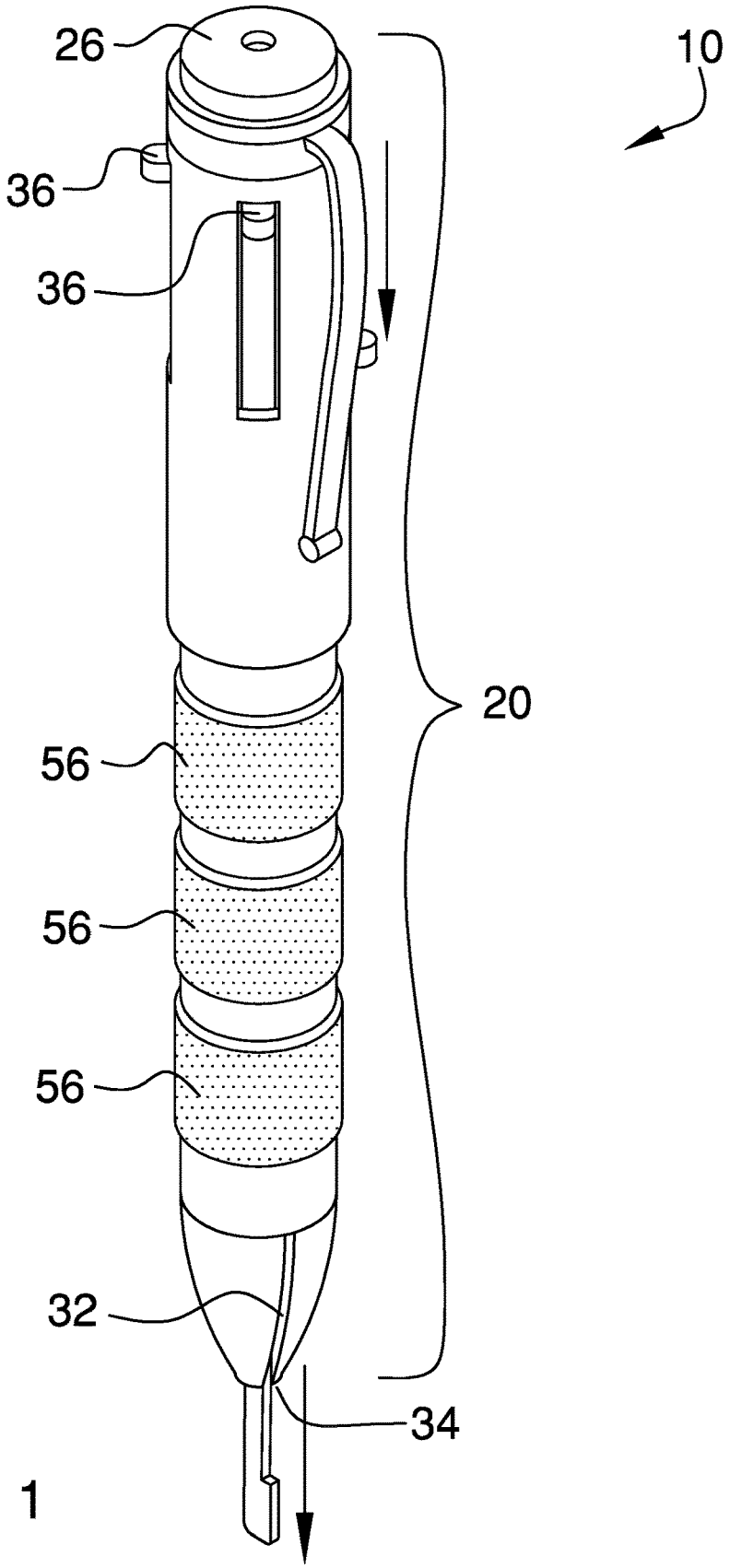
FIG. 1 is a front isometric view.
Figure 2:
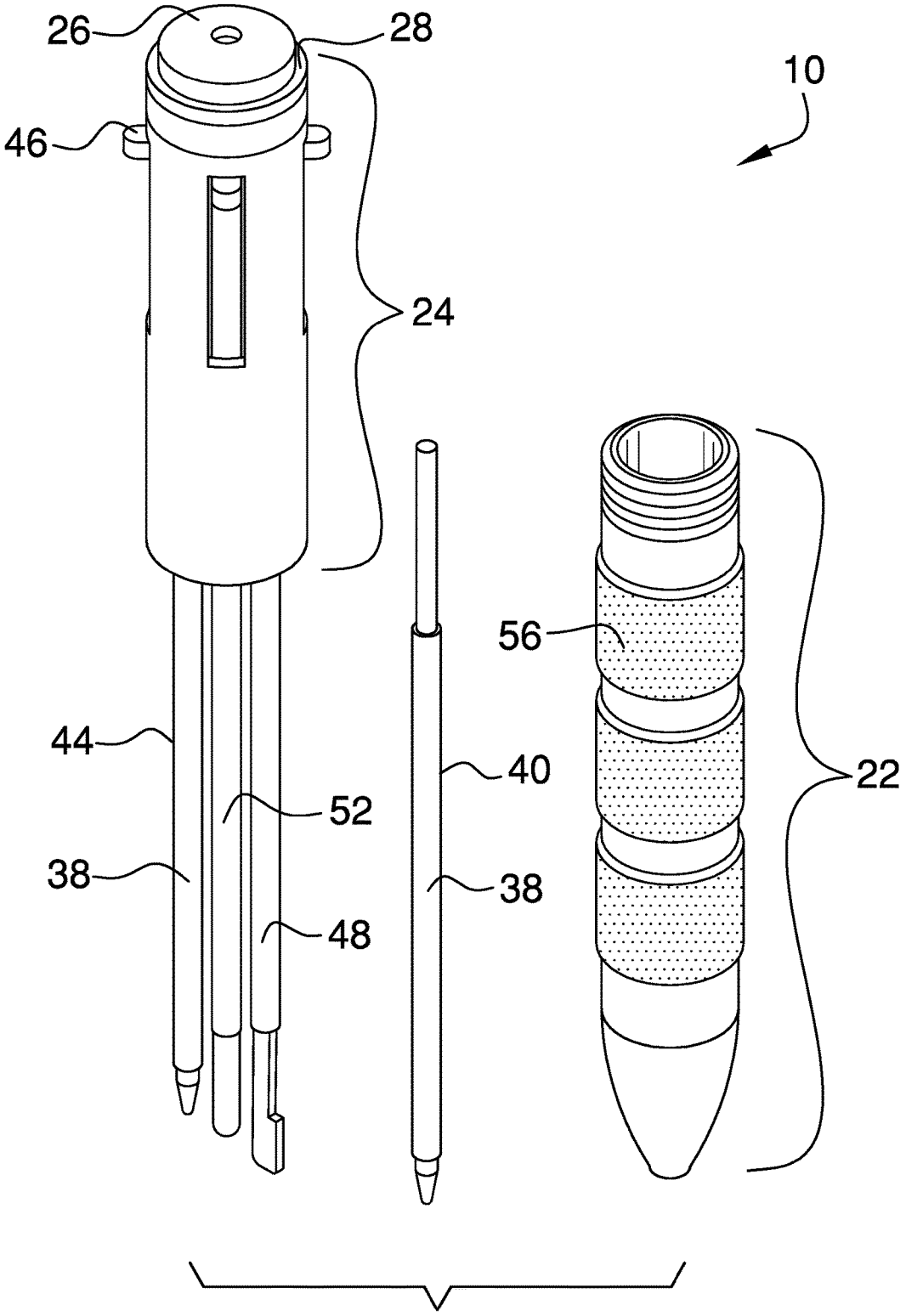
FIG. 2 is an exploded view.
Figure 3:
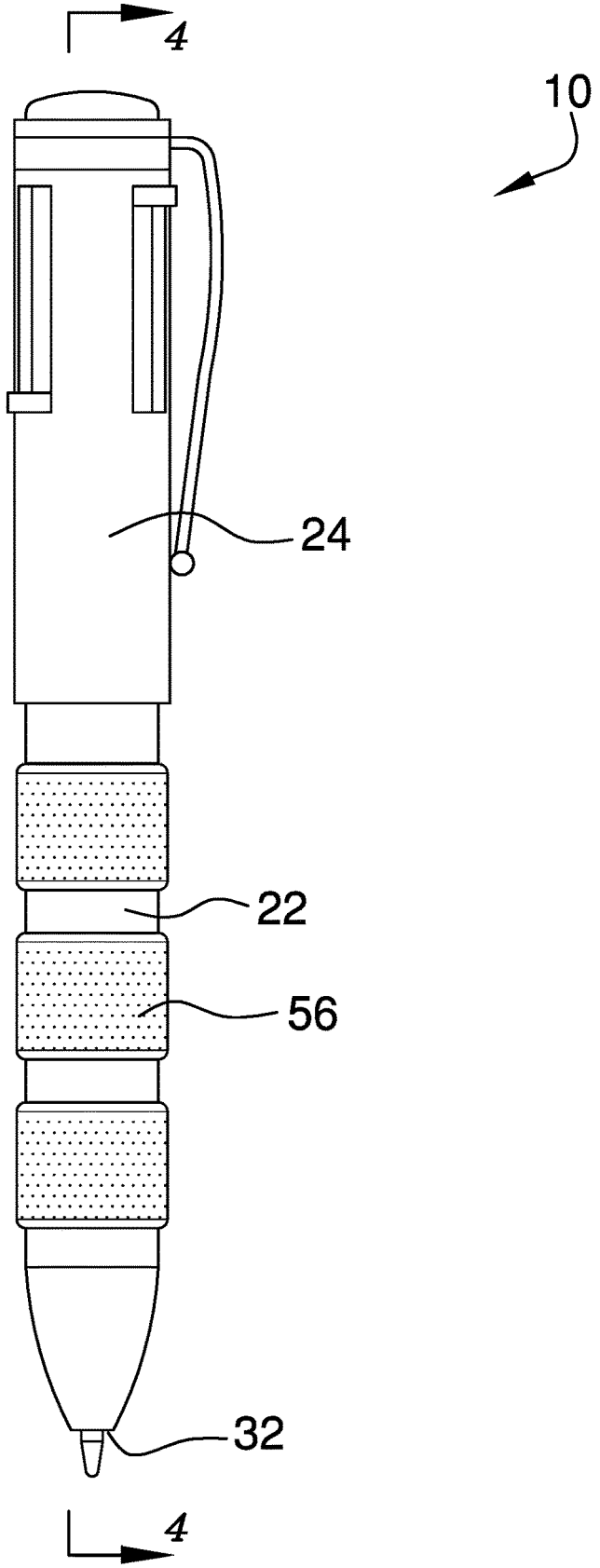
FIG. 3 is a side elevation view.
Figure 4:
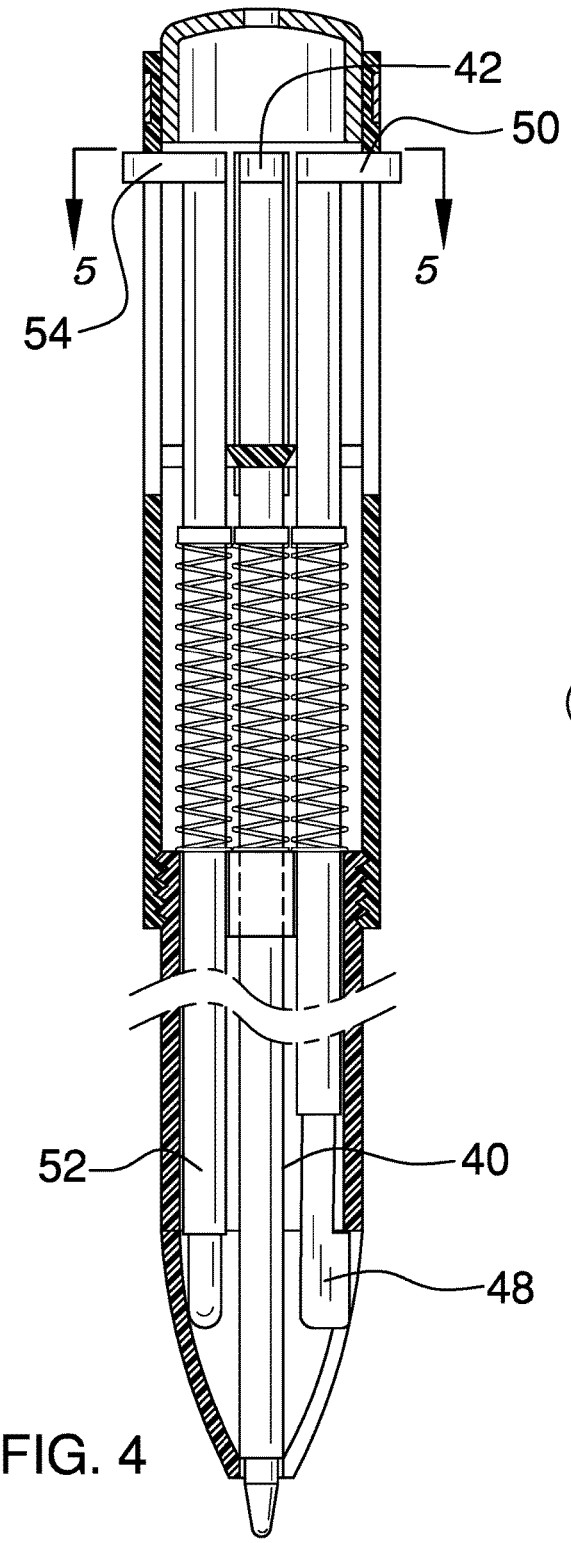
FIG. 4 is a cross-sectional view taken along line 4-4 of FIG. 3.
Figure 5:
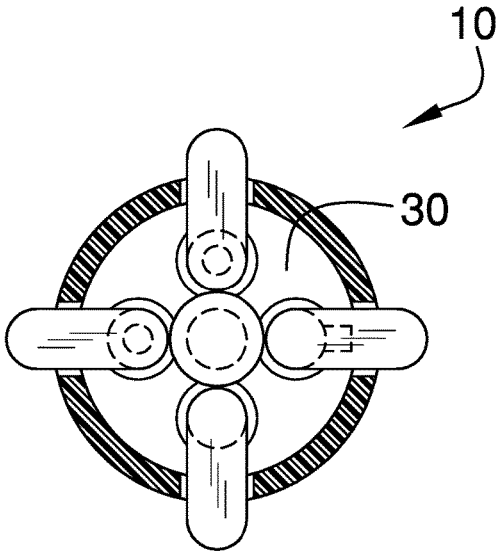
FIG. 5 is a cross-sectional view taken along line 5-5 of FIG. 4.

With reference now to the drawings, and in particular FIGS. 1 through 5 thereof, an example of the instant combination writing utensil and handcuff tool employing the principles and concepts of the present combination writing utensil and handcuff tool and generally designated by the reference number 10 will be described.

Referring to FIGS. 1 through 5 the present combination writing utensil and handcuff tool 10 is illustrated. The combination writing utensil and handcuff tool 10 includes an elongated substantially cylindrical writing utensil 20 having a lower portion 22, an upper portion 24 disposed atop the lower portion 22, a cap 26 disposed on a top end 28 of the upper portion 24, a slotted interior chamber 30, an opening 32 disposed in a bottom end 34 of the lower portion 22, and a plurality of spring-loaded depressible and releasable buttons 36 disposed within the upper portion 24 proximal the top end 28. A pair of writing tips 38 is disposed within the slotted interior chamber 30 of the elongated substantially cylindrical writing utensil 20, with a first of the pair of writing tips 40 engaged with a first of the plurality of spring-loaded depressible and releasable buttons 42 and selectively lockably extended through the opening 32 of the elongated substantially cylindrical writing utensil 20, and a second of the pair of writing tips 44 engaged with a second of the plurality of spring-loaded depressible and releasable buttons 46 and selectively lockably extended through the opening 32 of the elongated substantially cylindrical writing utensil 20. The combination writing utensil and handcuff tool 10 further includes a handcuff key 48 disposed within the slotted interior chamber 30 of the elongated substantially cylindrical writing utensil 20. The handcuff key 48 is engaged with a third of the plurality of spring-loaded depressible and releasable buttons 50 and selectively lockably extended through the opening 32 of the elongated substantially cylindrical writing utensil 20. Lastly, a handcuff lock 52 is disposed within the slotted interior chamber 30 of the elongated substantially cylindrical writing utensil 20. The handcuff lock 52 is engaged with a fourth of the plurality of spring-loaded depressible and releasable buttons 54 and selectively lockably extended through the opening of the elongated substantially cylindrical writing utensil 20.

At least one rubberized gripping member 56 is optionally disposed around a circumference of the lower portion 22 of the elongated substantially cylindrical writing utensil 20, with the at least one rubberized gripping member 56 optionally three.

What is claimed is:

1. A combination writing utensil and handcuff tool comprising:

an elongated substantially cylindrical writing utensil having a lower portion, an upper portion disposed atop the lower portion, a cap disposed on a top end of the upper portion, a slotted interior chamber, an opening disposed in a bottom end of the lower portion, and a plurality of spring-loaded depressible and releasable buttons disposed within the upper portion proximal the top end;

a pair of writing tips disposed within the slotted interior chamber of the elongated substantially cylindrical writing utensil, wherein a first of the pair of writing tips is engaged with a first of the plurality of spring-loaded depressible and releasable buttons and selectively lockably extended through the opening of the elongated substantially cylindrical writing utensil, and a second of the pair of writing tips is engaged with a second of the plurality of spring-loaded depressible and releasable buttons and selectively lockably extended through the opening of the elongated substantially cylindrical writing utensil;

a handcuff key disposed within the slotted interior chamber of the elongated substantially cylindrical writing utensil, wherein the handcuff key is engaged with a third of the plurality of spring-loaded depressible and releasable buttons and selectively lockably extended through the opening of the elongated substantially cylindrical writing utensil; and a handcuff lock disposed within the slotted interior chamber of the elongated substantially cylindrical writing utensil, wherein the handcuff lock is engaged with a fourth of the plurality of spring-loaded depressible and releasable buttons and selectively lockably extended through the opening of the elongated substantially cylindrical writing utensil.

2. The combination writing utensil and handcuff tool of claim 1 further comprising an at least one rubberized gripping member disposed around a circumference of the lower portion of the elongated substantially cylindrical writing utensil.

3. The combination writing utensil and handcuff tool of claim 2 wherein the at least one rubberized gripping member is three.

* * * * *